US009688942B2

(12) United States Patent
Meijer

(10) Patent No.: US 9,688,942 B2
(45) Date of Patent: Jun. 27, 2017

(54) POLYMER THICKENED GREASE COMPOSITION AND METHOD FOR MAKING THE SAME

(71) Applicant: AKTIEBOLAGET SKF, Göteborg (SE)

(72) Inventor: Dick Meijer, Wageningen (NL)

(73) Assignee: AKTIEBOLAGET SKF, Gothenburg (SE)

( * ) Notice: Subject to any disclaimer, the term of this patent is extended or adjusted under 35 U.S.C. 154(b) by 40 days.

(21) Appl. No.: 14/759,032

(22) PCT Filed: Jan. 8, 2014

(86) PCT No.: PCT/EP2014/050216

§ 371 (c)(1),
(2) Date: Jul. 2, 2015

(87) PCT Pub. No.: WO2014/108438

PCT Pub. Date: Jul. 17, 2014

(65) Prior Publication Data

US 2015/0368583 A1 Dec. 24, 2015

Related U.S. Application Data

(63) Continuation-in-part of application No. PCT/EP2013/050248, filed on Jan. 9, 2013.

(51) Int. Cl.
*C10M 119/00* (2006.01)
*C10M 119/14* (2006.01)
(Continued)

(52) U.S. Cl.
CPC ..... *C10M 169/06* (2013.01); *C10M 119/02* (2013.01); *C10M 169/02* (2013.01);
(Continued)

(58) Field of Classification Search
CPC C10M 169/06; C10M 177/00; C10M 119/02; C10M 169/02; C10M 2205/024;
(Continued)

(56) References Cited

U.S. PATENT DOCUMENTS 3,392,119 A * 7/1968 Mitacek ..... C10M 5/00 585/12
3,850,828 A * 11/1974 Dodson ..... C10M 5/00 585/12
(Continued)

FOREIGN PATENT DOCUMENTS

EP 0700986 A2 3/1996
EP 0795597 A1 9/1997
(Continued)

*Primary Examiner* — Pamela H Weiss
(74) *Attorney, Agent, or Firm* — Bryan Peckjian; SKF USA Inc. Patent Dept.

(57) ABSTRACT

A method for preparing a final grease product comprising steps of: (a) mixing a polymeric thickener, which comprises a polymer of propylene, and a lubricating base oil at a temperature above the melting point of the polymeric thickener, wherein the polymeric thickener is present in an amount of 11.5-15.5 wt %, based on the total weight of the mixture so obtained; (b) cooling the mixture as obtained in step (a); (c) subjecting the cooled mixture as obtained in step (b) to a first mechanical treatment, to obtain an intermediate grease; (d) subjecting the intermediate grease as obtained in step (c) to a second mechanical treatment, carried out at a temperature in the range of from 50-90° C., to obtain the final grease product. The method can be applied to manufacturing of a grease.

14 Claims, 1 Drawing Sheet

(51) Int. Cl.

| | |
|---|---|
| ***C10N 70/00*** | (2006.01) |
| ***C10M 123/04*** | (2006.01) |
| ***C10M 169/06*** | (2006.01) |
| ***C10M 169/02*** | (2006.01) |
| ***C10M 119/02*** | (2006.01) |
| ***C10M 177/00*** | (2006.01) |

(52) U.S. Cl.
CPC .... *C10M 177/00* (2013.01); *C10M 2205/024* (2013.01); *C10M 2205/0213* (2013.01); *C10M 2205/0285* (2013.01); *C10N 2220/021* (2013.01); *C10N 2220/033* (2013.01); *C10N 2230/68* (2013.01); *C10N 2240/02* (2013.01); *C10N 2240/52* (2013.01); *C10N 2240/54* (2013.01); *C10N 2250/10* (2013.01); *C10N 2270/00* (2013.01)

(58) Field of Classification Search
CPC .. C10M 2205/0213; C10M 2205/0285; C10N 2270/00; C10N 2250/10; C10N 2240/54; C10N 2240/52; C10N 2240/02; C10N 2220/021; C10N 2230/68; C10N 2220/033
See application file for complete search history.

(56) References Cited

U.S. PATENT DOCUMENTS

| | | | | | |
|---|---|---|---|---|---|
| 4,840,739 | A * | 6/1989 | Mori | C10M 169/00 | 508/131 |
| 5,773,394 | A * | 6/1998 | Wan | C10M 119/02 | 508/131 |
| 5,846,918 | A * | 12/1998 | Meijer | C10M 119/00 | 508/591 |
| 5,874,391 | A * | 2/1999 | Meijer | C10M 119/02 | 508/591 |
| 2007/0191238 | A1 * | 8/2007 | Fischer | C10M 123/04 | 508/465 |
| 2013/0331307 | A1 * | 12/2013 | Meijer | C10M 169/06 | 508/534 |

FOREIGN PATENT DOCUMENTS

| | | | | | |
|---|---|---|---|---|---|
| EP | 0795598 | A1 | 9/1997 | | |
| EP | 0942063 | A1 | 9/1999 | | |
| NL | EP 0795597 | A1 * | 9/1997 | C10M 119/00 | |
| NL | EP 0795598 | A1 * | 9/1997 | C10M 119/02 | |
| NL | EP 0700986 | B1 * | 7/1999 | C10M 119/02 | |
| NL | WO 2010017909 | A1 * | 2/2010 | C10M 123/04 | |
| NL | WO 2012076025 | A1 * | 6/2012 | C10M 169/06 | |
| NL | WO 2012076638 | A1 * | 6/2012 | C10M 169/06 | |
| WO | 2012055821 | A1 | 5/2012 | | |
| WO | 2012076638 | A1 | 6/2012 | | |

* cited by examiner

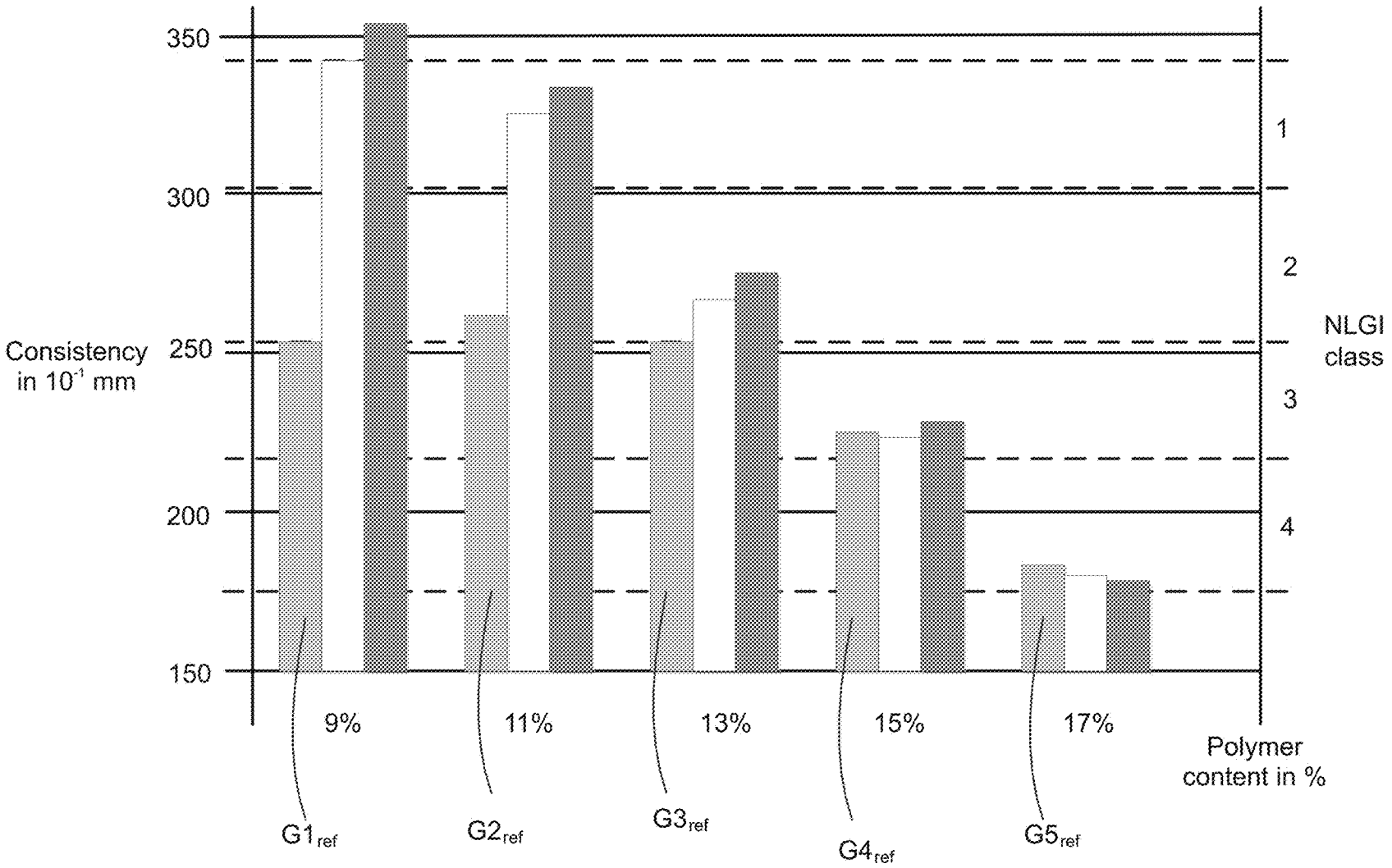
NLGI class
1
2
3
4
Polymer content in %
17%
15%
13%
11%
9%
G5ref
G4ref
G3ref
G2ref
G1ref
350
300
250
200
150
Consistency in 10⁻¹ mm

POLYMER THICKENED GREASE COMPOSITION AND METHOD FOR MAKING THE SAME

CROSS REFERENCE TO RELATED APPLICATIONS

This is a United States National Stage application claiming the benefit of International Application Number PCT/EP2014/050216 filed on 8 Jan. 2014, which depends from PCT/EP2013/050248 filed on 9 Jan. 2013, which are incorporated herein by reference in their entireties.

FIELD OF THE INVENTION

The present invention relates to a method for preparing a polymer thickened grease composition, and a grease composition.

BACKGROUND OF THE INVENTION

Polymer thickened lubricating greases and their preparation are known in the art. In U.S. Pat. No. 3,392,119, a grease is described comprising a white mineral oil that has been thickened by means of a copolymer of ethylene and a homopolymer of polypropylene. In U.S. Pat. No. 3,850,828, a lubricating grease composition has been described which is thickened with a polymeric mixture comprising a polyethylene and an atactic polypropylene. In EP 0700986 A2, a polymeric thickener for lubricating grease compositions is disclosed comprising containing a mixture of copolymers or homopolymers of polypropylene having a high molecular weight and a copolymer or homopolymer of propylene having a low molecular weight. Further, In EP 0942063, a lubricating grease composition is described comprising at least one polyolefin component, at least one base oil component and at least one rubber component.

A problem associated with grease compositions is that they are often not mechanically stable during the application it is intended for. Hence, not all polymer-thickened grease compositions show an acceptable mechanical stability during use.

SUMMARY OF THE INVENTION

An object of the present invention is to provide polymer thickened grease compositions with improved mechanical stability.

Surprisingly, it has now been found that grease compositions with an improved mechanical stability and excellent lubricating properties can be prepared when use is made of a particular amount of polymer and a specific mechanical treatment.

Accordingly, the present invention relates to a method for preparing a final grease product comprising the following steps:

(a) mixing a polymeric thickener, which comprises a polymer of propylene, and a lubricating base oil at a temperature above the melting point of the polymeric thickener, wherein the polymeric thickener is present in an amount of 11.5-15.5 wt %, based on the total weight of the mixture so obtained;

(b) cooling the mixture as obtained in step (a);

(c) subjecting the cooled mixture as obtained in step (b) to a first mechanical treatment, to obtain an intermediate grease;

(d) subjecting the intermediate grease as obtained in step (c) to a second mechanical treatment, carried out at a temperature in the range of from 50-90° C., to obtain the final grease product.

The polymer thickened grease as obtained in accordance with the present method displays a very attractive mechanical stability and good lubrication properties.

In step (a), the polymeric thickener is present in an amount of 11.5-15.5 wt %, based on the total weight of the mixture so obtained. Preferably, the polymeric thickener is present in an amount of 12-15 wt %, more preferably 12.5-14.5 wt %, most preferably 12.5-13.5 wt %, based on the total weight of the mixture so obtained.

The mixing in step (a) is carried out at a temperature above the melting point of the polymeric thickener. Preferably, step (a) is carried out at a temperature of 150-250° C. more preferably 190-210° C., although other temperatures may be used if required. The preparation of the grease composition in step (a) is preferably carried out under a protective atmosphere, such as a nitrogen gas flow, for avoiding oxidation of the oils during heating.

In step (a), the mixture is prepared by mixing the polymers in a manner known per se, which will involve heating and, if desired, the use of one or more suitable oils. The polymeric thickener is mixed with the lubricating base oil, and optionally also additives are mixed in by means of conventional techniques known in the art.

In step (b), the mixture as obtained in step (a) is suitably cooled from the mixing temperature as used in step (a) to room temperature. Suitably, the cooling step is a rapid cooling step or a so-called quenching step. The cooling can be carried out in a period of time between 1 sec.-3 min., preferably 5 sec.-1 min. More preferably, the cooling is carried out in less than 30 sec, even more preferably between 10 and 25 seconds. The rapid cooling can be carried out, for instance, by pouring the grease composition on a metal plate, although any other suitable rapid cooling method may also be used, such as spraying. The rapid cooling step as used in accordance with the present invention has a major influence on the grease structure, giving significant improvement of the properties of the final grease compositions compared to both conventional lubricating greases, as well as lubricating greases according to the invention which are cooled slowly, e.g. in approximately 1 degree per minute by the use of conventional cooling methods, such as simply keeping the grease in the reaction vessel with external/internal cooling.

In step (c), the cooled mixture as obtained in step (b) is subjected to a first mechanical treatment, to obtain an intermediate grease. The intermediate grease has a first consistency, which is stiffer than a desired consistency of the final grease product. The first mechanical treatment in step (c) may be carried out using e.g. a three-roll mill or other suitable milling apparatus. Other methods of mechanical shearing may be applied. The first mechanical treatment step is suitably carried out at ambient temperature, and is a treatment which is conventionally applied in the manufacture of grease products to obtain e.g. an homogenous mixture. Also, the addition of grease additives, such as anti-wear and/or anti-corrosion and/or extreme-pressure additives, generally takes place during the first mechanical treatment.

The final grease product has a desired consistency. In a preferred example, where the grease composition has a polymer thickener content of approx. 13%, the final grease product has a consistency which lies in NLGI class II. This is achieved by subjecting the intermediate grease to a second mechanical treatment in step (d), which is suitably carried out at a temperature in the range of from 50-90° C. Preferably, the mechanical treatment in step (d) is carried out at a temperature in the range of from 70-90° C., more preferably in the range of from 75-85° C. The mechanical treatment in step (d) may be carried out using a planetary mixer with heating means, although also other shearing methods may be applied. After step (d), the grease is ready for use.

The second mechanical treatment can suitably be carried out for a period of time in the range of from 1-20 hours, preferably in the range of from 2-10 hours. The amount of working time required to reach the desired consistency depends on the polymer content of the grease and the type of base oil and its viscosity.

The final grease product obtained after step (d) has a consistency which is close to a maximum softness of the grease. In other words, the final grease product is a mechanically stable grease.

Lubricant greases which are prepared in accordance with the present method have the following advantages, in addition to excellent improved mechanical stability, i.e. "roll" stability/shear stability:

improved bleeding of the oil at low temperatures (room temperature or less);

oil bleeding characteristics that are less temperature-dependent than the characteristics of lubricant grease compositions known in the state of the art;

better transport of the oil within the grease structure, which leads to improved grease service life;

good lubricating ability at low temperatures (below 70° C.); mechanical stability, i.e. "roll" stability/shear stability good grease noise characteristics; and long relubrication intervals.

DETAILED DESCRIPTION OF THE INVENTION

The present invention provides a method for preparing polymer thickened grease products. The method for preparing a final grease product comprises the following steps:

(a) mixing a polymeric thickener, comprising a polymer of propylene, and a lubricating base oil at a temperature above the melting point of the polymeric thickener, wherein the polymeric thickener is present in an amount of 11.5-15.5 wt %, based on the total weight of the mixture so obtained;

(b) cooling the mixture as obtained in step (a);

(c) subjecting the cooled mixture as obtained in step (b) to a first mechanical treatment, to obtain an intermediate grease;

(d) subjecting the intermediate grease composition as obtained in step (c) to a second mechanical treatment, carried out at a temperature in the range of from 50-90° C., to obtain the final grease product.

In a preferred embodiment of the present method, the polymeric thickener is present in step (a) in an amount of 12-15 wt %, based on the total weight of the mixture so obtained, and step (a) is carried out at a temperature of 150-250° C.; the cooling in step (b) is carried out in less than 30 sec; and the mechanical treatment in step (d) is carried out at a temperature in the range of from 70-90° C.

In a more preferred embodiment of the present invention, the polymeric thickener is present in step (a) in an amount of 12.5-14.5 wt %, based on the total weight of the mixture so obtained, and step (a) is carried out at a temperature of 190-210° C.; the cooling in step (b) is carried out between 10 and 25 seconds; and the mechanical treatment in step (d) is carried out at a temperature in the range of from 70-90° C.

It will be understood that the properties of the final grease product are of course also dependent on the properties of the lubricating oil and additives used, as is well known to a man skilled in the art.

The polymeric thickener to be used in accordance with the present invention comprises a polymer of propylene. Suitably, the polymeric thickener comprises a first component which comprises a polymer of propylene and a second component which comprises a polymer of propylene, with the first component having a higher weight average molecular weight than the second component.

Preferably, the polymeric thickener comprises a high molecular weight component and a low molecular weight component, characterized in that the thickener comprises a mixture of (1) a (co- or homo-)polymer of propylene with a weight average molecular weight of more than 200.000 (Da) and (2) a (co- or homo-)polymer of propylene with a weight average molecular weight of less than 200.000 (Da).

Preferably, the weight ratio between the high molecular weight component and the low molecular weight component is 1:40-1:5, preferably 1:25-1:15, more preferably 1:18-1:20.

In accordance with the present invention the low molecular weight component is preferably a polypropylene homopolymer. Preferably, the low molecular weight component has an average molecular weight in the range of from 20.000 and 100.000 (Da) and a melt flow rate (ASTM D-1238) in the range of from 500-1500, preferably 750-1250.

Suitably, the high molecular weight component is a polypropylene homopolymer or a propylene/ethylene-copolymer. Preferably, the high molecular weight component has an average molecular weight in the range of from 200.000-350.000 (Da) and a melt flow rate (ASTM D-1238) in the range of from 1.5-15, preferably 1.5-7.

Preferably, the polymeric thickener to be used in accordance with the invention comprises a mixture of (1) a (co- or homo-)polymer of propylene with an average molecular weight of more than 200.000 (Da) and (2) a (co- or homo-)polymer of propylene with an average molecular weight of less than 100.000 (Da).

The polymeric thickener according to the present invention may contain a high molecular weight component comprising a (co- or homo-)polymer of propylene with a weight average molecular weight of more than 200.000 (Da), preferably in the range of from 200.000-500.000 (Da) and a low molecular weight component comprising a (co- or homo-)polymer of propylene with a weight average molecular weight of less than 100.000 (Da), preferably in the range of from 50.000-100.000 (Da).

The weight ratio between the high molecular weight component and the low molecular weight component in the polymeric thickener is preferably in the range of from 1:40-1:5, more preferably in the range of from 1:25-1:15, and most preferably in the range of from 1:20-1:18.

Outside this preferred range for the weight ratio between the high and low molecular weight components the final lubricating grease composition may not have the desired application properties, in particular mechanical stability and consistency, i.e. be too "rubbery/elastic" and/or too "buttery". However, as the properties of the final composition are also dependent on the lubricant base oil and additives incorporated in grease compositions, as well as on the way the composition is prepared, other ratios may also be used for obtaining the desired properties of the final composition, as is well known to a man skilled in the art.

The low molecular weight component of the polymeric thickener is preferably a polypropylene homopolymer, more preferably a polypropylene homopolymer with a melt flow rate of 500-1000 dg/min., especially 750-850 dg/min. as determined by test ASTM D 1238 L.

The high molecular weight component of the polymeric thickener preferably has a melt flow rate (ASTM D-1238) of 1.5-15, more preferably 1.5-7, especially about 3.5.

As the lubricating base oil any lubricating oil known per se may be used, such as mineral oils, synthetic hydrocarbons, ester oils, vegetable (biodegradable) oils and mixtures thereof, of different viscosity. The type of base oil and viscosity can be selected to suit specific applications.

The mechanical stability of the polymer-thickened grease is dependent on the content of the polymer thickener and is further influenced by the thickener used, the lubricating base oil used, as well as the additives used.

The mechanical stability of the grease can be ascertained by means of tests known in the art, such as the Shell roll stability test according to ASTM D1831. Preferably, the final grease product will have a drop in penetration after the Shell roll stability test (24 hrs at 82° C., 165 rpm), of maximum 50 preferably less than 40, when consistency is measured in $10^{-1}$ mm via the cone penetration test of ASTM D217.

The consistency of greases can be further classified by means of the NLGI-class. According to the present invention, the grease can be prepared to a NLGI-class range of 2-3 or a consistency in the range of from 220-300, preferably in the range of from 260-295, (in $10^{-1}$ mm).

Apart from the polymeric thickener according to the invention, the lubricant grease composition may also contain conventional thickeners for lubricant grease compositions, such as metal soaps, in amounts of less than 75 wt. %, preferably less than 25 wt. %, as well as other polymeric thickeners.

Preferably, the lubricant grease compositions according to the invention contain only polymeric thickeners, most preferably the polymeric thickener mixture as described hereinabove.

The polymer thickened grease according to the present invention can be used for all conventional applications for lubricant grease compositions, so long as these are compatible with the components of the lubricant grease composition.

The greases prepared in accordance with the invention are especially suited for low temperature applications, for instance windmills. Also, on account of the long(er) relubrication intervals compared to conventional greases, the compositions according to the invention can advantageously be used in applications for which frequent relubrication is unpractical or undesired.

Further uses of the lubricant greases according to the present invention are e.g. agricultural machinery, bearings in dam-gates, low noise electric motors, large size electric motors, fans for cooling units, machine tool spindles, screw conveyors.

The present invention further relates to a lubricating grease obtainable by the method according to the present invention. The polymeric thickener is present in an amount of 11.5-15.5 wt %, based on the total weight of the mixture so obtained, and the lubricating grease has a consistency in the range of from 220-300 (in $10^{-1}$ mm). The polymeric thickener is preferably present in an amount of 12-14.5 wt %, more preferably 12.5-14.5 wt %, and most preferably 12.5-13.5 wt %, based on the total weight of the mixture so obtained.

Further, the lubricating grease suitably has a softness which corresponds to at least 80%, preferably at least 90% of the maximum softness of the grease composition.

The lubricating grease of the invention may additionally comprise at least one additive component which is selected from the group consisting of antioxidants, corrosion inhibitors, anti-wear agents and pressure tolerance-increasing additives, and wherein the total content of the additive component(s) is in the range between 0.1 and 15% by weight, and preferably between 1 and 8% by weight, based on the total weight of the grease composition.

The invention will now be further illustrated by the following Examples, which do not limit the invention in any way.

Examples

Two grease compositions A and B were prepared by mixing particular amounts of a high molecular weight polypropylene (average mw. 230,000), a low molecular weight polypropylene (average mw. 82,000), and a base-oil (Poly-Alpha Olefin (PAO) having viscosity 68 $mm^2/s$), and heating the mixture under nitrogen to 195° C. until complete dissolution of polypropylenes has taken place. The weight ratio of the low molecular weight polypropylene and high molecular propylene was in each case 19/1. The grease compositions so obtained were then rapidly cooled to room temperature in 30 seconds by pouring the mixture onto a metal plate.

Grease composition A comprises the following constituents: 13 wt % polypropylene in PAO200 (polyalphaolefin base oil), with no additives. Grease composition B comprises the following constituents: 13 wt % polypropylene in base oil of mineral oil 68, with the following additives: 0.5 wt % anti-oxidant; 2.5 wt % anti-corrosion and 2.5 wt % anti-wear additives.

The grease compositions A and B were then homogenized in a planetary mixer at ambient temperature, to obtain intermediate grease samples $A_{S1}$ and $B_{S1}$. The samples $A_{S1}$ and $B_{S1}$ are representative of conventional polymer-thickened greases prepared in a conventional manner. Further samples $A_{S2}$ and $B_{S2}$ were then prepared according to the method of the invention, by mechanically shearing the intermediate greases for approximately 3 hours at a temperature of 80° C. in a planetary mixer.

The initial consistency of the grease samples $A_{S1}$, $B_{S1}$, $A_{S2}$, $B_{S2}$ was measured via the cone penetration test in accordance with ASTM D217. Each sample was then subjected to a mechanical stability test in which the grease samples were mechanically sheared at a temperature of 80° C. for several hours. The consistency of each sample was measured after 24 hours of the mechanical stability test and again after 50 hours. The results are shown in table 1.

TABLE 1

| Grease Samples | Initial penetration ($10^{-1}$ mm) | Penetration ($10^{-1}$ mm) after mechanical stability test 24 h/80° C. | Penetration($10^{-1}$ mm) after mechanical stability test 50 h/80° C. |
|---|---|---|---|
| $A_{S1}$ | 231 | 290 | 285 |
| $B_{S1}$ | 229 | 294 | 277 |
| $A_{S2}$ | 271 | 289 | 297 |
| $B_{S2}$ | 265 | 299 | 305 |

The grease compositions A and B are designed for rolling bearing applications in which the desired consistency of the grease is between 260 and $295\times10^{-1}$ mm.

The intermediate grease samples $A_{S1}$ and $B_{S1}$ have a stiffness of around $230\times10^{-1}$ mm, which is too high for the intended bearing application. The relatively stiff grease would generate a high amount of friction. Furthermore, the intermediate greases become considerably softer when subjected to the mechanical stability test. Penetration increases by more than $50\times10^{-1}$ mm, which is considered by bearing manufacturers as an unacceptable level of mechanical stability.

By contrast, the grease samples $A_{S2}$ and $B_{S2}$ prepared according to the method of the invention have an initial consistency which is desirable for the intended bearing application. Furthermore, the samples $A_{S2}$ and $B_{S2}$ display an acceptable level of mechanical stability, with an increase in penetration of max. $40\times10^{-1}$ mm. The inventive sample of composition A displays an increase of only $26\times10^{-1}$ mm.

The mechanical stability of grease products prepared using the method steps of the invention depends on the polymer content. The effect of polymer content on mechanical stability was investigated by preparing five grease products as follows.

Five grease compositions G1, G2, G3, G4 and G5 were prepared by mixing particular amounts of a high molecular weight polypropylene (average mw. 230,000), a low molecular weight polypropylene (average mw. 82,000), and a base-oil (Poly-Alpha Olefin (PAO) having viscosity 68 $mm^2/s$), and heating the mixture under nitrogen to 195° C. until complete dissolution of polypropylenes has taken place. The weight ratio of the low molecular weight polypropylene and high molecular propylene was in each case 19/1. The five grease compositions had a total polypropylene content of 9 wt % (G1), 11 wt % (G2), 13 wt % (G3), 15 wt % (G4) and 17 wt % (G5) respectively. The grease compositions so obtained were then rapidly cooled to room temperature in 30 seconds by pouring the mixture onto a metal plate.

A reference sample of each grease composition $G1_{ref}$, $G2_{ref}$, $G3_{ref}$, $G4_{ref}$, $G5_{ref}$ was then prepared by carrying out steps (c) and (d) of the inventive method. Specifically, the grease compositions were sheared in a three-roll mill at ambient temperature and then subjected to mechanical shearing in a planetary mixer at a temperature of 80° C. for 1-6 hours until a desired consistency, suitable for bearing applications, was obtained. The duration of the thermo-mechanical treatment depends on the polypropylene content of the grease composition. A consistency of around NLGI class 2-3 (corresponding to a cone penetration depth of approx. $225\text{-}295\times10^{-1}$ mm) is desirable for bearing applications. NB it is to be noted that for the grease composition with 17 wt % polypropylene content, a reference sample of desired consistency could not be produced.

The consistency of each reference sample was measured using the cone penetration method as defined in ASTM D217. Next, each reference sample was subjected to further mechanical shearing at a temperature of 80° C. The consistency of each reference sample was measured again after 24 hours of this treatment and then after 50 hours. The results are shown in the bar chart of FIG. 1, whereby for each reference sample, the left-hand bar shows the initial measured consistency of the reference sample, the middle bar shows the measured consistency after 24 hours of shearing at 80° C. and the right-hand bar shows the measured consistency after 50 hours of shearing at 80° C.

Looking at the 9% composition, it can be seen that mechanical shearing of the reference sample $G1_{ref}$ at a temperature of 80° C. leads to considerable softening (a drop of around $70\times10^{-1}$ mm occurs). In other words, the 9% composition exhibits unacceptable mechanical stability. The reference sample of the 11% composition $G2_{ref}$ displays better mechanical stability, although still exhibits significant softening.

Looking now at the reference sample of the 13% composition $G3_{ref}$, it can be seen that very little softening occurs after 24 hours and then after 50 hours, while for the 15% composition, the consistency of the reference sample $G4_{ref}$ remains essentially constant under the aforementioned thermo-mechanical treatment. The consistency of the 17% composition also remains quite constant, and even becomes somewhat stiffer, which is undesirable.

Thus, a grease product prepared according to the method of the invention has a polymer content of greater than 11 wt % and less than 15.5 wt %, such that a mechanically stable grease of desired consistency is obtained.

The invention claimed is:

1. A manufactured grease obtainable by a method comprising steps of:

(a) mixing a polymeric thickener and a lubricating base oil at a temperature above the melting point of the polymeric thickener, wherein the polymeric thickener is present in an amount of 11.5-15.5 wt. %, based on the total weight of the mixture so obtained;

(b) cooling the mixture as obtained in step (a) to room temperature in less than 30 seconds;

(c) subjecting the cooled mixture as obtained in step (b) to a first mechanical treatment, to obtain an intermediate grease; and (d) subjecting the intermediate grease as obtained in step (c) to a second mechanical treatment, carried out at a temperature in the range of from 50-90° C., to obtain the manufactured grease, wherein the polymeric thickener comprises:

a low molecular weight polypropylene having an average molecular weight in the range of 20,000-100,000 Da and a melt flow rate (ASTM D-1238) in the range of 750-1250; and a high molecular weight polypropylene having an average molecular weight in the range of 200,000-350,000 Da and a melt flow rate (ASTM D-1238) in the range of 1.5-7; and wherein the high molecular weight component and the low molecular weight component are present in a weight ratio of between 1:25 and 1:15; and the manufactured grease has a cone penetration depth in the range of $260\text{-}295\times10^{-1}$ mm according to ASTM D217.

2. The manufactured grease according to claim 1, which additionally comprises at least one additive component which is selected from the group consisting of antioxidants, corrosion inhibitors, anti-wear agents and pressure tolerance-increasing additives, and wherein the total content of the additive component(s) is in the range between 1 and 8% by weight, based on the total weight of the grease composition.

3. The manufactured grease according to claim 1, wherein the weight ratio between the high molecular weight component and the low molecular weight component is 1:20-1:18.

4. A method, comprising:

(a) mixing a polymeric thickener, which comprises at least one polymer of propylene, and a lubricating base oil at a temperature of 150-250° C. to form a mixture, wherein the polymeric thickener is present in an amount of 11.5-15.5 wt. % based on the total weight of the mixture;

(b) quenching the mixture obtained in step (a) to room temperature in between 1 second and 3 minutes;

(c) subjecting the cooled mixture obtained in step (b) to milling at room temperature, to obtain an intermediate grease; and (d) further mixing the intermediate grease obtained in step (c) in a planetary mixer for 1-20 hours at the temperature in the range of from 50-90° C., to obtain a final grease product having a cone penetration depth in the range of $260\text{-}295\times10^{-1}$ mm according to ASTM D217.

5. The method according to claim 4, wherein the polymeric thickener comprises:

a low molecular weight polypropylene having an average molecular weight in the range of 20,000-100,000 Da and a melt flow rate (ASTM D-1238) in the range of 750-1250; and a high molecular weight polypropylene having an average molecular weight in the range of 200,000-350,000 Da and a melt flow rate (ASTM D-1238) in the range of 1.5-7; and wherein the high molecular weight component and the low molecular weight component are present in a weight ratio of between 1:25 and 1:15.

6. The method according to claim 4, wherein the polymeric thickener is present in an amount of 12-15 wt. %, based on the total weight of the mixture so obtained.

7. The method according to claim 4, wherein the polymeric thickener is present in an amount of 12.5-13.5 wt. %, based on the total weight of the mixture so obtained.

8. The method according to claim 4, wherein the temperature in step (d) is in the range of from 70-90° C.

9. The method according to claim 4, wherein the at least one polymer of propylene of the polymeric thickener comprises a first component which comprises a first polymer of propylene and a second component which comprises a second polymer of propylene, the first component having a higher weight average molecular weight than the second component.

10. The method according to claim 9, wherein the first component is a (co- or homo-)polymer of propylene having a weight average molecular weight of more than 200,000 and the second component is a (co- or homo-)polymer of propylene having a weight average molecular weight of less than 200,000.

11. The method according to claim 10, wherein the weight ratio between the first component and the second component is 1:40-1:5.

12. The method according to claim 10, wherein the second component is a polypropylene homopolymer.

13. The method according to claim 10, wherein the second component has an average molecular weight between 20,000 and 100,000 and a melt flow rate (ASTM D-1238) of 500-1500.

14. The method according to claim 10, wherein the first component is one of a polypropylene homopolymer or a propylene/ethylene-copolymer.

* * * * *